US007293913B2

(12) United States Patent
Peters et al.

(10) Patent No.: US 7,293,913 B2
(45) Date of Patent: Nov. 13, 2007

(54) BALANCE-SPRING WITH ALTERED OUTER CURVE

(75) Inventors: Jean-Bernard Peters, La Chaux-de-Fonds (CH); Marco Verardo, Les Bois (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 11/169,912

(22) Filed: Jun. 30, 2005

(65) Prior Publication Data

US 2006/0002240 A1 Jan. 5, 2006

(30) Foreign Application Priority Data

Jul. 2, 2004 (EP) ..... 04015578

(51) Int. Cl.
*G04B 17/04* (2006.01)

(52) U.S. Cl. ..... 368/175; 368/178

(58) Field of Classification Search ..... 368/127, 368/161, 168, 175–178; 267/156, 166
See application file for complete search history.

(56) References Cited

U.S. PATENT DOCUMENTS 1,037,741 A 9/1912 Dudley
3,550,928 A 12/1970 Antritter
3,872,663 A * 3/1975 Meitinger ..... 368/178
3,955,809 A * 5/1976 Hara et al. ..... 267/156
5,294,097 A * 3/1994 Thomsen et al. ..... 267/156

FOREIGN PATENT DOCUMENTS

CH 327 796 2/1958

* cited by examiner

*Primary Examiner*—Vit W Miska
(74) *Attorney, Agent, or Firm*—Sughrue Mion, PLLC

(57) ABSTRACT

The balance-spring (1) includes a plurality of coils (3) of which the end (6, 8) of the outer curve (2) is rigidified by deformation in order to define accurately the setting point (7) of said balance-spring, said deformation being able to be achieved by bending the end (6) of the outer curve (2) through 90° in a plane perpendicular to the height of the balance-spring (1) or by folding down through 180° a portion of the end (8) of the outer curve (2) against the inner or outer face of said end (2).

4 Claims, 1 Drawing Sheet

BALANCE-SPRING WITH ALTERED OUTER CURVE

FIELD OF THE INVENTION

The present invention concerns a balance-spring, in particular for integration in the sprung-balance regulating device of a timepiece, whose outer curve is altered to define accurately the active length of said balance-spring, thereby helping to reduce the variation of the daily rate.

BACKGROUND OF THE INVENTION

It is well known that the isochronism of a sprung-balance regulating device can be disrupted by variations in external conditions, such as the temperature and magnetic field. In order to compensate for, or reduce the influence of such variations, numerous solutions have been proposed and/or retained as regards the choice of materials, or forming of the balance and balance-spring.

As far as the balance-spring is concerned, the shaping of the inner curve for securing it to the balance staff, the shaping of the outer curve for securing it to the balance-cock, and the means implemented for carrying out said securing play a determining part as regards isochronism. The invention concerns more specifically the means for securing the outer curve to the balance-cock, directly or via a balance-spring stud, generally supported by a mobile balance-spring stud carrier for positioning the balance-spring.

The outer curve of the balance-spring is most often secured by pins or bonding, although other solutions have been proposed. It has, for example, been proposed to add an inertia-block, set in one edge of the balance-cock, to the end of the curve, as disclosed for example in U.S. Pat. No. 1,037,741, wherein the inertia-block has a triangular shape. Such a construction makes manufacture of the balance-spring more complicated, in order to form an inertia-block at one end and requires a particular arrangement of the balance-cock, different from the usual arrangement of the balance-cock stud.

The usual securing using pins or bonding has the drawback of not guaranteeing the positioning of the point of contraction/expansion of the balance-spring over time, either because of slight movement, or because of aging and/or the glue crumbling.

SUMMARY OF THE INVENTION

It is thus an object of the present invention to overcome the drawbacks of the aforecited prior art by providing a balance-spring whose outer curve can be secured by known techniques, without requiring any alteration to the balance-cock stud and whose point of contraction/expansion, also called the setting point, does not undergo any alteration over time.

The invention therefore concerns a balance-spring comprising a plurality of coils for a sprung-balance regulating device wherein the inner curve is secured to a balance staff pivoting in the balance-cock enabling the outer curve of said balance-spring to be secured directly or indirectly, the end of said curve being rigidified by deformation to define accurately the setting point, whatever means are used for the securing.

According to a first embodiment, the deformation is carried out by twisting the end of the outer curve through 90° in a perpendicular plane to the height of the balance-spring, preferably in the extension of the median axis of the coils.

When the securing is carried out for example by bonding in the slit of a balance-cock stud secured to the balance-cock, or a balance-cock stud carrier, it will be observed that twisting the end of the outer curve does not alter the width of the balance-spring strip, such that it is not necessary to alter the stud. Thus the setting point no longer depends upon the way in which the adhesive is placed, nor upon aging, but upon the point rigidified by twisting the end of the balance-spring.

According to a second embodiment, the deformation is carried out by folding the end of the outer curve through 180° against the inner or outer face of said end, and by bonding or welding to hold the fold more securely, wherein the distal folded down part defines the setting point.

BRIEF DESCRIPTION OF THE DRAWINGS

Other features and advantages of the present invention will appear in the following description, given by way of non-limiting illustration, with reference to the annexed drawings, in which.

Figure shows a partially torn away top view of a sprung-balance provided with a balance-spring according to the invention.

DETAILED DESCRIPTION OF THE INVENTION

Figure 1:
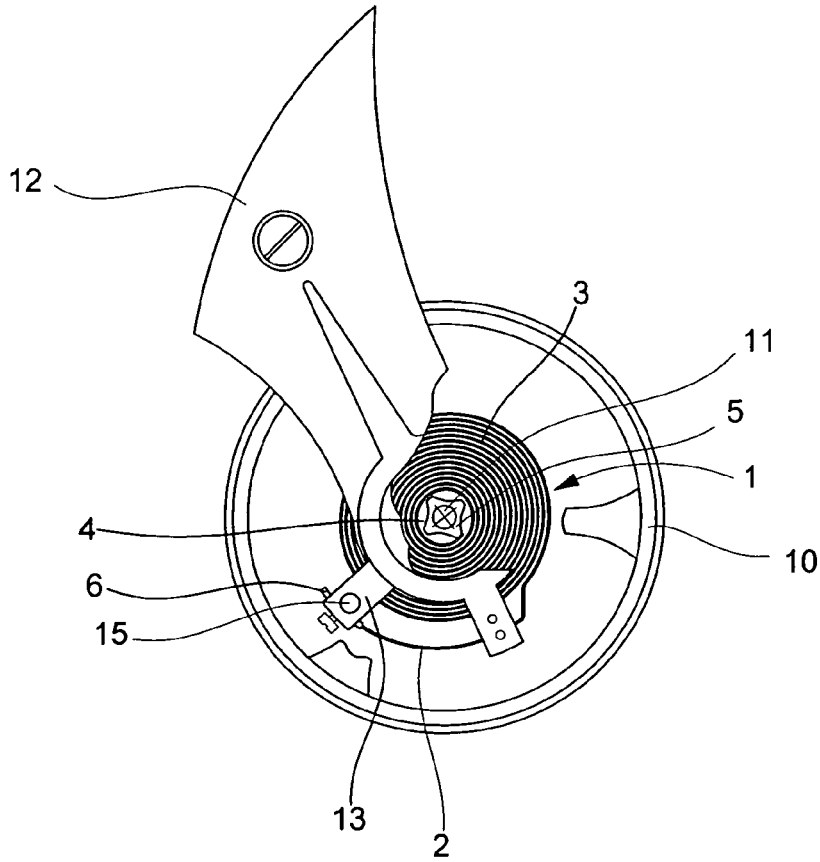

FIG. 1 shows a sprung-balance regulating device in a partially torn away view, limited to the parts useful for comprehension of the invention.

The regulating device comprises a balance 10 for securing the inner curve 4 of the balance-spring by means of a collet 5 driven onto the balance-staff 11. Inner curve 4 can evidently be secured by any other means known to those skilled in the art. The outer curve is secured to the balance-cock 12. In the example shown, it is generally secured by being set in a balance-cock stud 15 fixed in a balance-cock stud carrier 13, said setting generally being achieved by bonding. Usually, the end of the outer curve, with a generally rectangular section (h, e) is in the extension of the coils 3, with the exception of the Breguet balance-spring, which is scarcely used any more.

Figure 2:
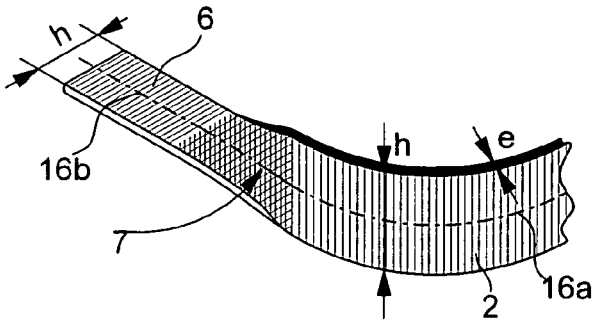
FIG. 2 is an enlarged perspective diagram of the end of the outer curve of the balance-spring of FIG. 1 according to a first embodiment.

The present invention proposes, however, to deform the end 6 of the outer curve such that the balance-spring setting point 7 is no longer defined by balance-cock stud 15, but by the balance-spring itself at the place where it has been rigidified, as shown in FIG. 2. As can be seen in this example, the creation of setting point 7 is obtained by twisting end 6 of outer curve 2 through 90°, so as to bring said end into a plane perpendicular to the height "h" of the coils, the median line 16*a* of the coils preferably being in the extension of median line 16*b* of bent portion 6.

Figure 3:
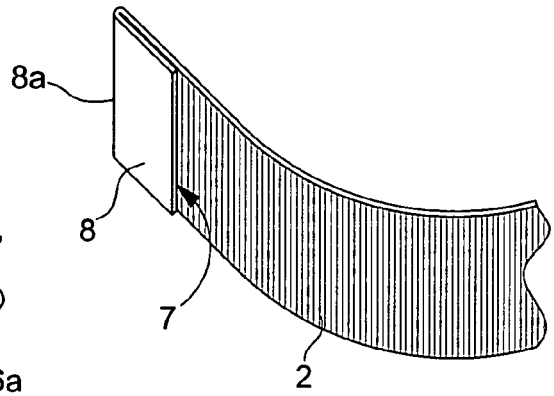
FIG. 3 is similar to FIG. 2 according to a second embodiment of the invention.

In a second embodiment shown in FIG. 3, setting point 7, defining the active length of the balance-spring, is formed by folding a portion 8 (corresponding to portion 6 in the preceding example) through 180° against the outer face of outer curve 2, or equally against the inner face. The parts in contact can be held in place by bonding, welding or any other equivalent means.

Two examples of comparative tests will be added now, showing the advantages provided by a balance-spring according to the invention, having an outer curve altered in accordance with the first embodiment.

EXAMPLE 1

A first series of measurements were carried out with a balance-spring whose end 6 bent through 90°0 is stopped in the hole passing through the balance-cock stud. The mean period measured is then 418065 μs. By carrying out successive mounting and demounting, in the same experimental conditions, the mean period measured is 418061 μs, i.e. an entirely negligible variation of 4 μs.

In a second series of measurements, end 6 was not stopped, but shifted by an angle of 3° measured with respect to the balance-staff. According to horological theory, the period variation should be 604 μs. However, with a balance-spring according to the invention, the mean period measured is 418010 μs, i.e. a deviation of 55 μs with respect to the first series of measurements, which is around 11 times less than the value that could be expected with a non-bent balance-spring. This value can be correlated to an increase in rigidity of the balance-spring strip by a factor of 11 given that the other construction parameters of the strip (h, e and length) remain unchanged.

EXAMPLE 2

In this example four different balance-springs (A, B, C, D) are taken, whose outer curve has been altered in accordance with the first embodiment, and the variations in daily rate (second/day) have been compared for three securing points of the outer curve. In a first position, the bent portion 6 is stopped in the balance-spring stud hole, in a second position said portion 6 is slightly withdrawn and in the third position it has been shifted by an angle $\alpha=7°$ with respect to the balance staff. It is specified that the object of this test was not to make a sprung-balance regulating device having a zero variation in daily rate, but to compare the rate variations. The results are shown in the table below.

| | Balance-spring A | Balance-spring B | Balance-spring C | Balance-spring D |
|---|---|---|---|---|
| Position 1 | −334.4 | −283.1 | −358.0 | −310.4 |
| Position 2 | −335.4 | −285.2 | −345.4 | −320.2 |
| Position 3 | −341.5 | −290.4 | −350.4 | −315.9 |
| Maxi variation (seconds) | 7.1 | 7.3 | 12.6 | 9.8 |

It appears that the maximum mean variation is of the order of 10 seconds, i.e. one tenth of what would have been expected in accordance with horological theory, i.e. a variation of 100 seconds for an angular shift of 7°.

This test demonstrates that this new design of the outer curve makes the accuracy of setting in the balance-cock stud much less important.

It is clear that, without departing from the scope of the present invention, those skilled in the art can alter and rigidify the setting end of the outer curve, without adding any material and whatever material is used to make said balance-spring. Likewise, the advantages of the present invention can be added with other improvements that could be made as regards the inner curve.

What is claimed is:

1. A balance-spring having an inner curve and an outer curve, and including a plurality of coils for a sprung-balance regulating device, wherein the inner curve is secured to a balance staff pivoting in a balance-cock, and the outer curve of said balance-spring is directly or indirectly secured to a balance-spring stud by an end portion, wherein the end of the outer curve is rigidified by a deformation made in the vicinity of the balance-spring stud to define accurately the setting point of said balance-spring, and wherein the deformation is achieved by twisting the end of the outer curve through 90° in a plane perpendicular to the height of the balance-spring.

2. Balance-spring according to claim 1, wherein the median axis of the bent end is in the extension of the median axis of the coils.

3. A balance-spring having an inner curve and an outer curve, and including a plurality of coils for a sprung-balance regulating device, wherein the inner curve is secured to a balance staff pivoting in a balance-cock, and the outer curve of said balance-spring is directly or indirectly secured to a balance-spring stud by an end portion, wherein the end of the outer curve is rigidified by a deformation made in the vicinity of the balance-spring stud to define accurately the setting point of said balance-spring, and wherein the deformation is achieved by bending a portion of the end of the outer curve through 180° against the inner or outer face of said end.

4. Balance-spring according to claim 3, wherein the portion bent through 180° is bonded or welded against the inner or outer face of the end of the outer curve.

* * * * *